US005585895A

United States Patent [19]

Yashiro et al.

[11] Patent Number: 5,585,895

[45] Date of Patent: Dec. 17, 1996

[54] DEVELOPING DEVICE AND PROCESS CARTRIDGE WITH IT

[75] Inventors: Masahiko Yashiro, Yokohama; Toshiyuki Karakama, Tokyo; Atsushi Numagami, Hadano, all of Japan

[73] Assignee: Canon Kabushiki Kaisha, Tokyo, Japan

[21] Appl. No.: 193,879

[22] Filed: Feb. 9, 1994

Related U.S. Application Data

[63] Continuation of Ser. No. 993,658, Dec. 21, 1992, abandoned.

[30] Foreign Application Priority Data

Dec. 19, 1991 [JP] Japan ..... 3-354792
Sep. 4, 1992 [JP] Japan ..... 4-260615

[51] Int. Cl.[6] ..... G03G 15/08

[52] U.S. Cl. ..... 355/215; 355/245; 355/260

[58] Field of Search ..... 355/215, 245, 355/259, 260; 118/657–8; 222/DIG. 1

[56] References Cited

U.S. PATENT DOCUMENTS

| | | | |
|---|---|---|---|
| 4,285,297 | 8/1981 | Suzuki | 118/657 |
| 5,016,560 | 5/1991 | Asada et al. | 118/653 |
| 5,019,861 | 5/1991 | Surti | 355/200 |
| 5,047,805 | 9/1991 | Oka et al. | 355/253 |
| 5,057,868 | 10/1991 | Sekino et al. | 355/215 |
| 5,073,797 | 12/1991 | Ono et al. | 355/215 |
| 5,084,733 | 1/1992 | Katoh et al. | 355/251 |
| 5,134,960 | 8/1992 | Shirai | 118/653 |
| 5,166,472 | 11/1992 | Maeda et al. | 118/653 |
| 5,202,729 | 4/1993 | Miyamoto et al. | 355/251 |
| 5,212,521 | 5/1993 | Ogawa et al. | 355/215 |
| 5,274,425 | 12/1993 | Fukimoto et al. | 355/215 |
| 5,338,895 | 8/1994 | Ikegawa et al. | 118/661 |

*Primary Examiner*—Thu Anh Dang
*Attorney, Agent, or Firm*—Fitzpatrick, Cella, Harper & Scinto

[57] ABSTRACT

An elastic regulating member for regulating thickness of a layer of developer conveyed to a developing station by a rotatable developing sleeve is abutted against the developing sleeve. At a toner return inlet of a container associated with the developing sleeve, a flexible sheet for preventing the developer in the container from leaking through the toner return inlet is abutted against the developing sleeve along a longitudinal direction thereof. Side seals are abutted against both longitudinal end portions of the developing sleeve to prevent the developer from leaking through such longitudinal end portions. Both longitudinal end portions of the flexible sheet are overlapped with sheet supporting surfaces formed on extensions of the side seals without any clearance. Further, the both longitudinal end portions of the flexible sheet are abutted against the developing sleeve at areas outwardly of both ends of the elastic regulating member.

8 Claims, 5 Drawing Sheets

DEVELOPING DEVICE AND PROCESS CARTRIDGE WITH IT

This application is a continuation of application Ser. No. 07/993,658, filed Dec. 21, 1992, now abandoned.

BACKGROUND OF THE INVENTION

1. Field of the Invention

The present invention relates to a developing device for developing an electrostatic latent image, and a process cartridge including such developing device and removable with respect to an image forming apparatus.

2. Related Background Art

In developing devices, in order to feed out developer from a container containing the developer and convey the developer to a developing station where an electrostatic latent image is developed, a rotatable developer bearing member such as a developing roller or developing sleeve has been used. The rotatable developer bearing member returns the developer which was not adhered to the electrostatic latent image to the container.

In many conventional developing devices, a flexible sheet member made of polyethylene terephthalete is arranged at a return opening of the container, so that the developer returned from the developing station by the developer bearing member is permitted to pass through the return opening and enter into the container, but the developer in the container is prevented from leaking through the return opening toward a direction opposite to a rotational direction of the developer bearing member.

The flexible sheet member is urged against the developer bearing member along a longitudinal direction thereof. Further, the flexible sheet member is secured to a fixing surface of the container at a position upstream of an urged portion between the developer bearing member and the sheet member in the rotational direction of the developer bearing member.

By the way, it is difficult to urge the flexible sheet member against the developer bearing member with high accuracy, and the urging condition between the sheet member and the developer bearing member varies as the developing device is used for a long time. If the urging condition between the sheet member and the developer bearing member is improper, the developer in the container will leak and/or the developer returned from the developing station will be prevented from passing through the return opening, thereby causing the scattering of the developer.

On the other hand, in some developing devices, an elastic regulating member made of urethane rubber and the like is urged against the developer bearing member to regulate a thickness of a layer of the developer conveyed to the developing station by the developer bearing member. Further, generally, side seal members made of moltprene, felt or the like are urged against both longitudinal end portions of the developer bearing member along the rotational direction of the developer bearing member so as to prevent the developer from leaking through such end portions.

However, it is not preferable that longitudinal ends of the elastic regulating member are abutted against the side seal members, because such abutment causes elastic deformation of a portion of the elastic regulating member, thus making the urging force between the elastic regulating member and the developer bearing member uneven or non-uniform to lead in the uneven thickness of the developer layer.

Accordingly, it is necessary to provide small clearances or gaps between the ends of the elastic regulating member and the side seal members. In this case, the developer in the container will leak through such gaps. If the developer leaked through the gaps is not positively collected or returned to the container, the scattering of the developer will occur.

SUMMARY OF THE INVENTION

An object of the present invention is to provide a developing device which can prevent the scattering of developer, and a process cartridge including such developing device.

Another object of the present invention is to provide a developing device wherein an abutment condition between a rotatable developer bearing member and a flexible sheet member arranged at a return inlet of a container can be stabilized, and a process cartridge including such developing device.

A further object of the present invention is to provide a developing device wherein developer leaked through longitudinal ends of an elastic regulating member for regulating a thickness of a developer layer can be collected to a container, and a process cartridge including such developing device.

The other objects and features will be apparent from the following detailed explanation.

DETAILED DESCRIPTION OF THE DRAWINGS

Figure 1:
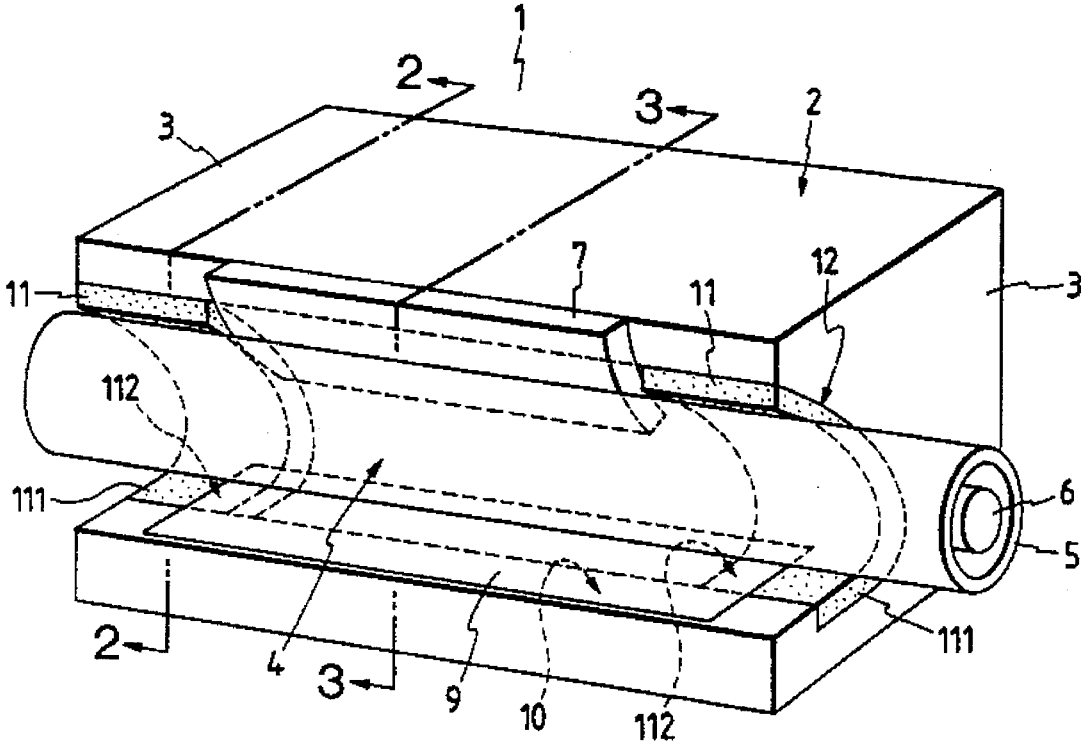
FIG. 1 is a perspective view of a developing device according to a preferred embodiment of the present invention.
Figure 2:
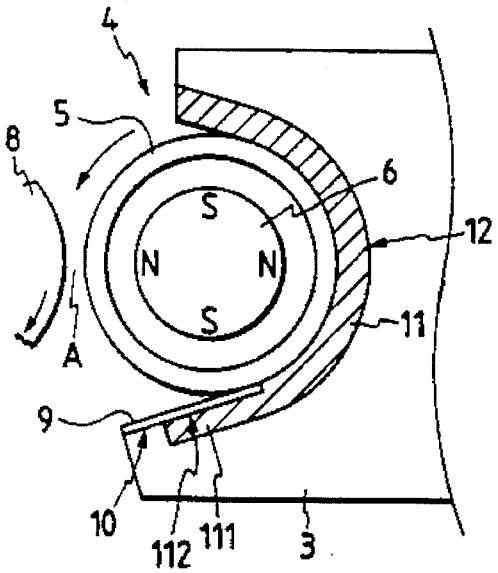
FIG. 2 is a sectional view taken along the line E—E of FIG. 1.
Figure 3:
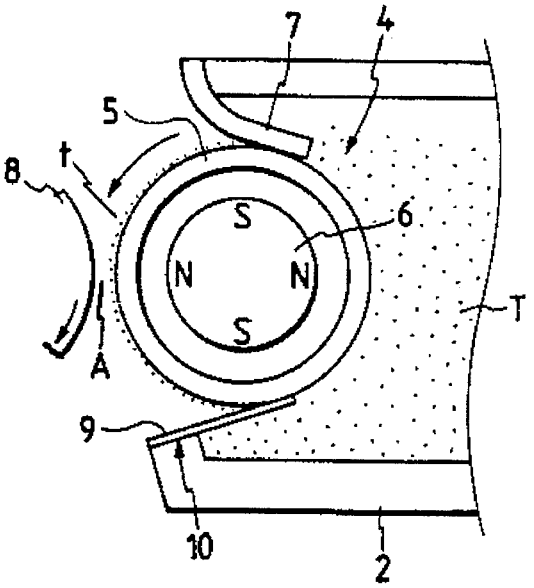
FIG. 3 is a sectional view taken along the line F—F of FIG. 1.

In FIGS. 1 to 3, a developing device 1 has a container 2 within which magnetic toner T as one-component magnetic developer is contained.

As the binding resin for the magnetic toner there can be used singly or in combination homopolymers of styrene or substituted styrene such as polystyrene, polyvinyltoluene, etc., styrene copolymers such as styrene-propylene copolymer, styrene-vinyltoluene copolymer, styrene-vinylnaphthalene copolymer, styrene-ethyl acrylate copolymer, styrene-butyl acrylate copolymer, etc., polymethyl methacrylate, polybutyl methacrylate, polyvinyl acetate, polyethylene, polypropylene, polyvinyl butyral, polyacrylic acid resin, rosin, modified rosin, terpene resin, phenolic resin, aliphatic or alicyclic hydrocarbons, aromatic petroleum resin, paraffin wax, carnauba wax and the like.

Coloring materials which can be added to the magnetic toner may be conventional carbon black, copper phthalocyanine, iron black or the like. Magnetic fine particles included in the magnetic toner may be made of material which can be magnetized under magnetic field and which may be iron powder, cobalt powder, nickel powder or the like, or alloy or compound such as magnetite, ferrite or the like.

Incidentally, the present invention can be applied to developing devices wherein one-component non-magnetic developer or two-component developer is used.

The container 2 is provided with an opening portion 4 within which a non-magnetic developing sleeve 5 made of aluminium, stainless steel or the like is disposed. Within the developing sleeve 5, there is disposed a fixed roller-shaped magnet 6.

In developing an electrostatic latent image, the sleeve 5 is rotatingly driven in a direction shown by the arrow. The toner T in the container 2 is magnetically adhered to the sleeve 5 by a magnetic force of the magnet 6, and frictional charge for developing the electrostatic latent image is obtained by the friction between the toner and the sleeve 5.

The toner T is conveyed out of the container 2 by the rotation of the sleeve 5; meanwhile, a thickness of a toner layer formed on the sleeve 5 is regulated by an elastic blade 7 made from a metal (for example, bronze phosphide, stainless steel) spring plate or a rubber (for example, urethane rubber, silicone rubber) plate.

The elastic blade 7 has one widthwise end fixed to the container 2, and a free widthwise end elastically urged against the sleeve 5 along a longitudinal direction thereof so as to form a nip between the sleeve 5 and the blade 7. When the toner passes through the nip, a uniform toner layer t is formed on the sleeve.

The toner layer t is conveyed, by the rotation of the sleeve 5, to a developing station A where the electrostatic latent image formed on an electrophotographic photosensitive drum 8 rotated in a direction shown by the arrow is developed.

In order to improve the developing efficiency and to prevent the fog of an developed image, it is preferable to apply a developing bias voltage (for example, vibration bias voltage obtained by overlapping a DC voltage to an AC voltage) to the sleeve 5.

The toner which is not used in the developing station A, i.e., the toner which is not adhered to the latent image is returned to the container 2 by the rotation of the sleeve 5.

By the way, as mentioned above, the elastic blade 7 is disposed at an outlet of the container 2 between the sleeve 5 and the container (i.e. a toner supply outlet). Thus, the leak of the toner from the container through the outlet is prevented by the elastic blade 7. On the other hand, in order to prevent the leak of the toner from the container through an inlet of the container 2 between the sleeve 5 and the container (i.e. a toner return inlet for returning the toner passed through the developing station A), a thin flexible sheet 9 formed from an elastic body made of synthetic resin is disposed at the toner return inlet. The flexible sheet 9 has one widthwise end secured to a sheet fixing surface 10 of the container 2 by an adhesive, both-sided adhesive tape or the like. It is most preferable that the flexible sheet 9 is secured to the sheet fixing surface 10 along the whole longitudinal length of the sheet; but, the flexible sheet may be secured to the sheet fixing surface 10 at a plurality of points along the longitudinal length of the sheet.

On the other hand, a free end portion of the flexible sheet is slightly urged against the sleeve 5 elastically. The toner returned from the developing station A enters into the container 2 while pushing up the flexible sheet 9 slightly as the sleeve 5 is rotated.

The lead of the toner T from the toner return inlet of the container 2 is prevented by the flexible sheet 9.

Incidentally, actually, there are thin toner layers between the elastic blade 7 and the sleeve 5, and between the flexible sheet 9 and the sleeve 5. However, if there are no such toner layers, since the elastic blade 7 and the flexible sheet 9 are elastically abutted against the sleeve 5, in this specification, it is referred that "elastic blade and flexible sheet are abutted or urged against sleeve" even when there are such toner layers.

As mentioned above, the undesired leak of the toner from the container 2 through the outlet and the inlet is prevented by the blade 7 and the sheet 9. 0n the other hand, in order to prevent the leak of the toner from the container through both longitudinal ends of the sleeve 5, side seals 11 made of elastic material such as felt, moltprene or the like are elastically urged against both longitudinal end portions of the sleeve 5 along the rotational direction of the sleeve. The side seals 11 are secured to seal fixing surfaces 12 formed on side walls 3 of the container 2 by an adhesive, both-sided adhesive tape or the like.

By the way, if a longitudinal length of the flexible sheet 9 is smaller than a distance between the pair of side seals 11 along the longitudinal direction of the sleeve, two gaps are created between both longitudinal ends of the flexible sheet 9 and the side seals, with the result that the toner in the container is leaked through the gaps due to the gravity of the toner.

In order to prevent this, as shown in FIG. 1, the longitudinal length of the flexible sheet 9 is selected to be greater than the distance between the side seals along the longitudinal direction of the sleeve. As shown in FIG. 2, the both longitudinal end portions of the flexible sheet 9 are urged against the sleeve 5 while being overlapped with the side seals 11. The side seals 11 serve to slightly contact the both longitudinal end portions of the flexible sheet 9 with the sleeve 5 elastically. In other words, the both longitudinal end portions of the flexible sheet 9 are pinched by the sleeve 5 and the pair-of side seals 11, at an abutment zone between the sheet and the sleeve 5.

Figure 4:
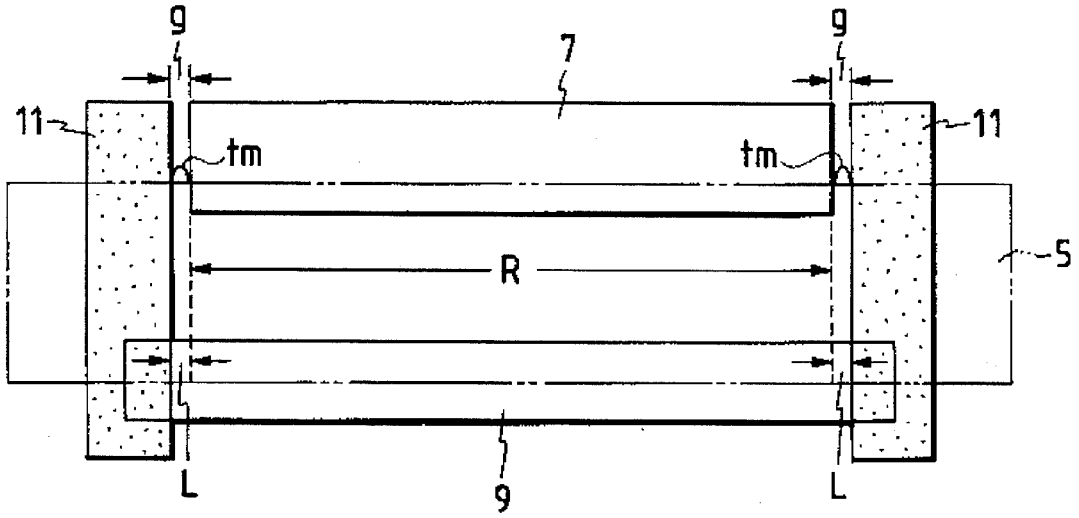
FIG. 4 is a view showing positional relations of an elastic blade, a flexible sheet and side seals with respect to a developing sleeve.

On the other hand, as shown in FIG. 4, it is preferable that the both longitudinal ends of the elastic blade 7 are spaced apart from the end surfaces of the side seals 11 with small gaps g, because, if the both longitudinal ends of the elastic blade 7 are abutted against the side seals 11, the blade 7 will be delicately deformed, thus making the abutment force between the blade 7 and the sleeve 5 uneven along the longitudinal direction of the sleeve, with the result that the thickness of the toner layer t will be uneven along the longitudinal direction of the sleeve.

Now, when the side seals 11 are arranged to be spaced apart, with the small gaps g, outwardly from both ends of the abutment zone R between the elastic blade 7 and the sleeve 5 (i.e. regulating zone R for regulating the thickness of the layer of the developer), toner layers tm thicker than the toner layer t in the regulating zone are leaked as strips through the gaps g as the sleeve 5 is rotated.

However, as mentioned above, the longitudinal length of the flexible sheet 9 is longer than the longitudinal length of the elastic blade 7 as shown in FIG. 4. In other words, the flexible sheet 9 is abutted against the sleeve 5 in such a manner that the flexible sheet is overlapped at its both ends with the side seals 11 at regions outwardly from the abutment zone R between the elastic blade 7 and the sleeve 5 with distances L. Accordingly, the flexible sheet 9 is uniformly abutted against the sleeve 5 between the pair of side seals 11 (including the distances L) even when the sleeve is rotated. Thus, the strip-shaped toner layers tm are smoothly collected into the container 2 by the flexible sheet 9, thereby preventing the scattering of the toner.

Incidentally, the distance L is preferably equal to or greater than the gap g; but, the distance L may be slightly smaller than the gap g.

By the way, in order to abut the flexible sheet 9 against the sleeve 5 with higher accuracy and to maintain the good abutment condition between the flexible sheet and the sleeve for a long time, as shown in FIGS. 1 and 2, zones of the longitudinal end portions of the flexible sheet 9 between the fixing portions of the sheet to the fixing surface 10 and the abutment portions of the sheet against the sleeve 5 are overlapped with extensions 111 of the side seals 11. More specifically, in the toner return inlet, the side seals 11 have extensions 111 extending away from the sleeve 5 in a direction opposite to the rotational direction of the sleeve. The sheet 9 is closedly rested on upper surfaces 112 of the extension 111 without any clearance and is supported in such a condition.

Incidentally, the flexible sheet 9 is not adhered to the side seals 11, but is closedly contacted with the side seals 11 for sliding movement with respect to the side seals. Thus, undesired deformation of the flexible sheet 9 can be prevented, with the result that the flexible sheet can be abutted against the sleeve 5 more uniformly in the longitudinal direction.

The upper surfaces of the extensions 111, i.e. sheet supporting surfaces 112 are flat. Further, the sheet fixing surface 10 formed on the container 2 is also flat. Furthermore, the sheet fixing surface 10 is flush with the supporting surfaces 112. Accordingly, since the flexible sheet 9 is held substantially flat ahead of the abutment area between the sheet and the sleeve 5 so that the flexible sheet is not forcibly bent or deformed, the flexible sheet 9 can be abutted against the sleeve 5 with high accuracy and such abutment condition can stably be maintained for a long time.

It is most preferable that the sheet supporting surfaces 112 of the extensions 111 of the side seals 11 are flat and are flush with the fixing surface 10 as mentioned above, because the sheet supporting surfaces 112 can be formed flatly with high accuracy and when the sheet supporting surfaces 112 are flat the flexible sheet 9 can easily be overlapped with the supporting surfaces 112 without any clearance there between.

However, if the flexible sheet 9 can be overlapped with the sheet supporting surfaces 112 of the extensions 111 substantially without any clearance therebetween, the supporting surfaces 112 may be made convex or concave slightly. Also in this case, it is preferable that there is no step between the fixing surface 10 and the sheet supporting surfaces 112 at the boundaries therebetween so that the flexible sheet 9 is not bent at such boundaries, i.e. the flexible sheet can extend across such boundaries in a flat condition. In any case, by doing so, the toner leaked from the gaps g can be collected into the container 2 more smoothly.

Figure 5A:
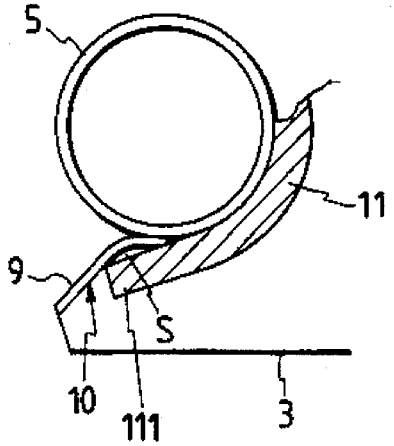
FIGS. 5A and 5B are views showing a gap between the flexible sheet and the side seal.
Figure 5B:
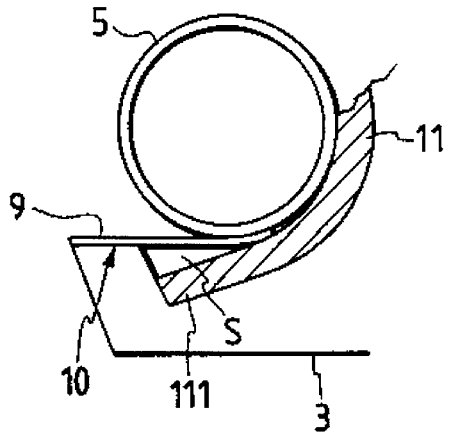

Incidentally, FIGS. 5A and 5B show a condition that a space or gap S is created between the extension 111 of the side seal 11 and the flexible sheet 9. In this condition, the toner in the container will be leaked.

Next, a process cartridge incorporating the above-mentioned developing device will be explained.

The process cartridge integrally holds therein an image bearing member such as an electrophotographic photosensitive drum and a developing device, and if necessary, a charger and a cleaning device, which process cartridge can be removably mounted within an image forming apparatus. When the developer in the developing device is used up or when the image bearing member is deteriorated, the process cartridge is dismounted from the image bearing apparatus, and a new process cartridge is mounted within the image forming apparatus.

Figure 6:
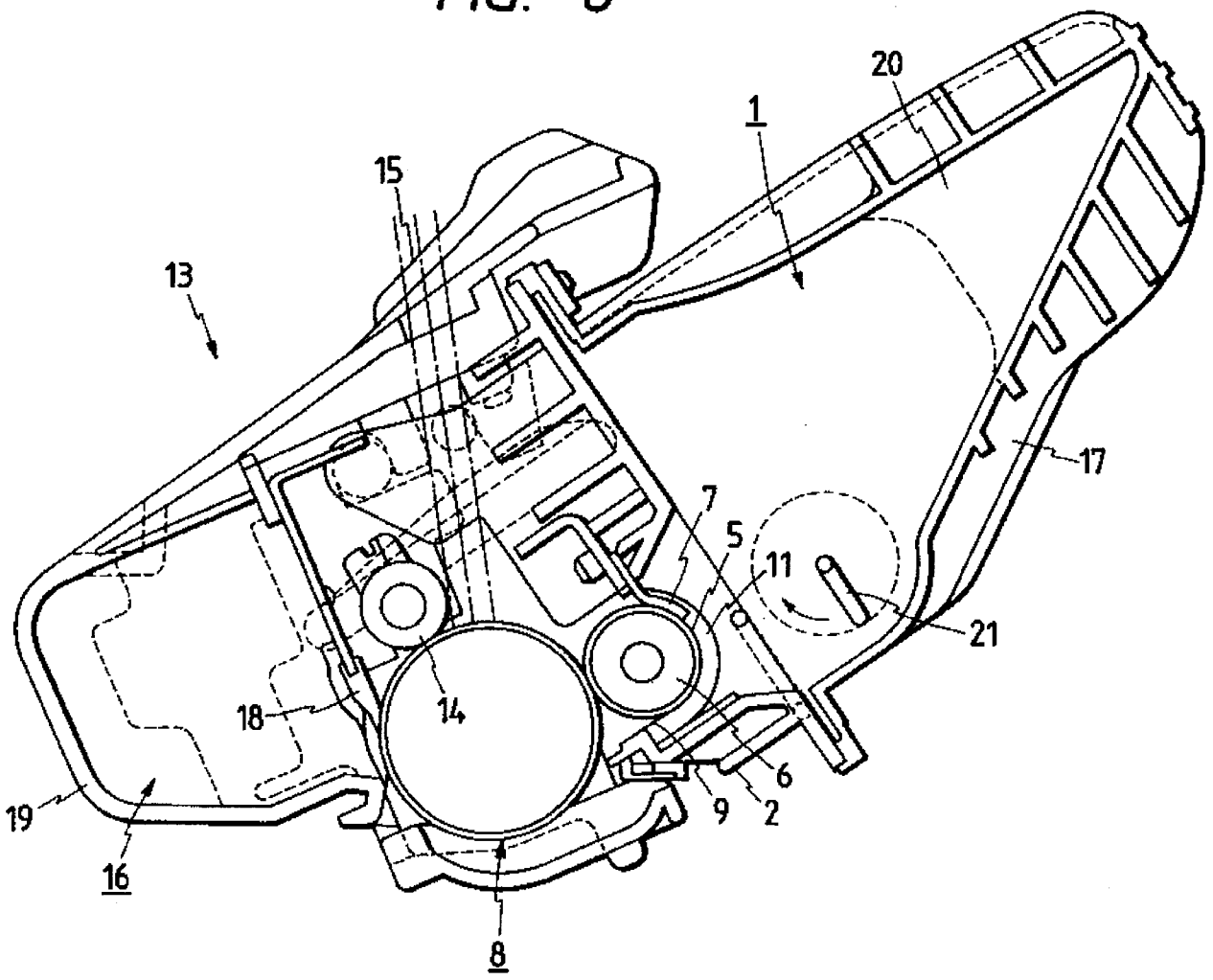
FIG. 6 is a sectional view of a process cartridge according to a preferred embodiment of the present invention.

A process cartridge 13 shown in FIG. 6 includes a charger 14, an exposure portion 15 and a developing device 1 for developing an image with toner, which elements are disposed around an electrophotographic photosensitive drum 8 and are enclosed by a housing comprising first to third frames 17, 2, 19. That is to say, the process cartridge 13 is constituted by interconnecting the first frame 17 having a toner reservoir chamber 20, the second frame 2 supporting a developing sleeve 5 and the like, and the third frame 19 supporting the photosensitive drum 8, cleaning device 16 and charger 14.

As shown in FIG. 6, the developing device 1 for forming a toner image with magnetic toner has the toner reservoir chamber 20 for reserving the toner, and a toner feeding member 21 rotated in a direction shown by the arrow is disposed in the toner reservoir chamber 20 to feed the toner out of the chamber. The toner fed from the chamber is supplied to the developing sleeve 5 having a magnet 6 therein, thereby forming a thin toner layer on the sleeve. When the toner layer is formed on the developing sleeve 5, the toner is frictionally charged sufficiently to develop an electrostatic latent image formed on the photosensitive drum 8, by the friction between the toner and the rotating developing sleeve 5. Further, in order to regulate a thickness of the toner layer, an elastic blade 7 is abutted against the surface of the developing sleeve 5.

In the illustrated embodiment, a voltage obtained by overlapping a DC voltage (about −500 V) with an AC voltage (Vpp=about 1600 V) is applied as a developing bias voltage.

Incidentally, the toner reservoir chamber 20 and the toner feeding member 21 are provided in the first frame 17, and the developing sleeve 5, elastic blade 7, flexible sheet 9 and side seals 11 are attached to the second frame 2. These first and second frames are integrally connected to each other by welding the interfaces therebetween.

Figure 7:
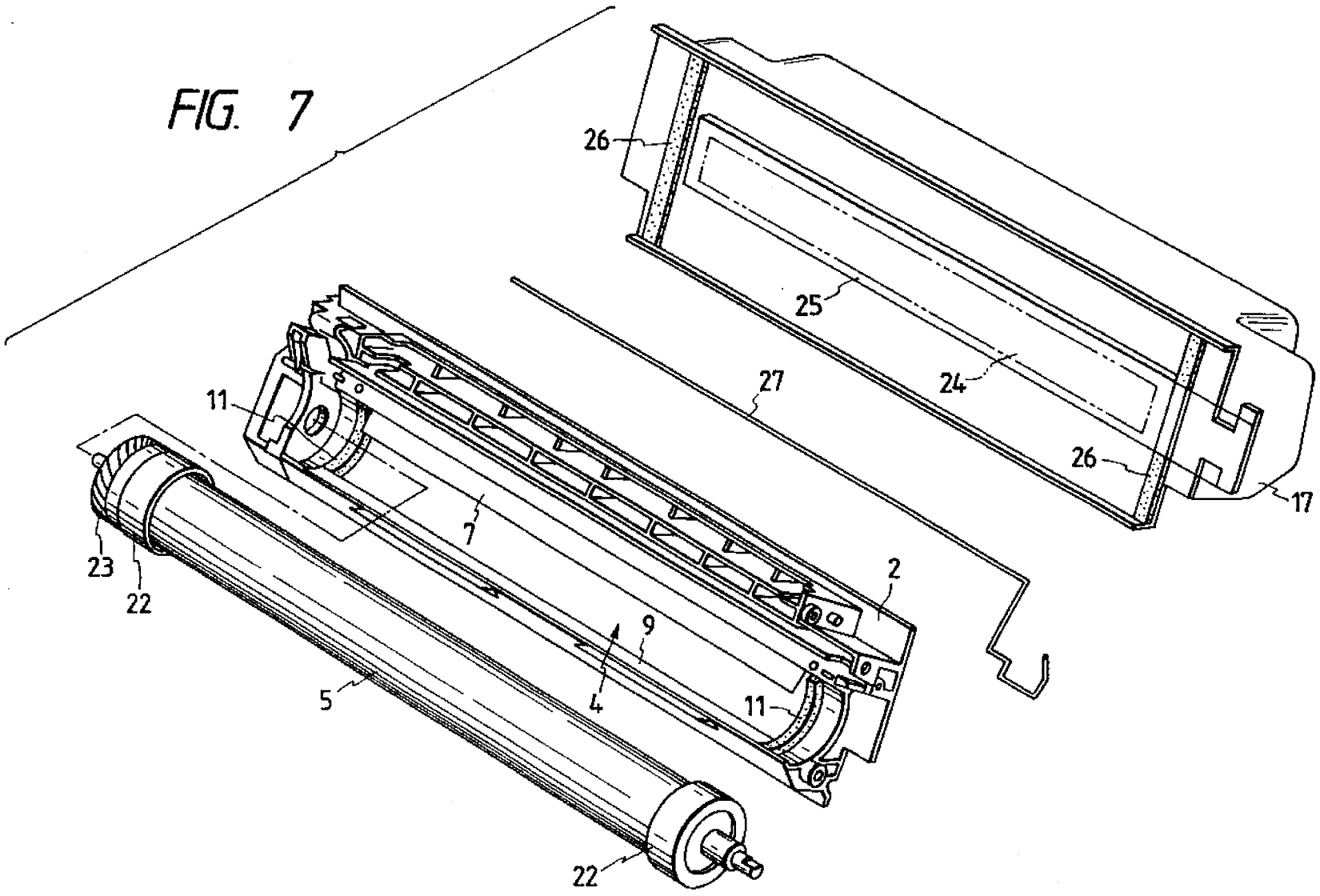
FIG. 7 is an exploded perspective view of a developing device of the process cartridge of FIG. 6.

The developing sleeve 5 on which is the toner layer is formed is opposed to the photosensitive drum 8 with a small gap (about 250 μm) therebetween. Thus, in the illustrated embodiment, as shown in FIG. 7 abutment rings 22 having a radius greater than that of the developing sleeve by a value corresponding to the above-mentioned gap are arranged on both longitudinal ends of the developing sleeve 5 out of a toner layer forming area, which abutment rings are abutted against the photosensitive drum 8 out of a latent image forming area.

A gear 23 is attached to one longitudinal end of the developing sleeve 5 for rotation together with the sleeve. The gear 23 is meshed with a herical gear (not shown) secured to one end of the photosensitive drum 8, so that the developing sleeve 5 can be rotated as the photosensitive drum 8 rotates. Further, the gear 23 is also meshed with a gear (not shown) connected to the toner feeding member 21 to transmit the rotational force of the photosensitive drum 8 to the toner feeding member 21.

Incidentally, the formation of the toner layer on the developing sleeve 5 is effected only at a carbon dispersing resin coating portion coated on the developing sleeve 5, and a longitudinal (axial) length of the photosensitive layer on the photosensitive drum 8 is greater than that of a charging area on the photosensitive drum charged by the charger 14, which is in turn greater than that of the toner layer forming area (toner layer regulating area) on the developing sleeve 5.

Incidentally, the elastic blade 7, flexible sheet 9 and side seals 11 are attached to the frame 2 in the same manner as described in connection with FIGS. 1 to 4.

Since the first frame 17 and second frame 2 are welded at the longitudinal interfaces therebeween, the toner cannot be leaked through such interface. However, the first frame 17 and the second frame 2 cannot be welded at widthwise interfaces therebetween, because, as shown in FIG. 7, an opening 24 formed in the first frame 17 must be sealed by a cover film 25 to prevent the toner in the toner reservoir chamber 20 of a new (non-used) process cartridge 13 from leaking and the end of the cover film 25 must be extended through the widthwise side of the assembled frames so that the cover film can be pulled and removed to open the opening 24 when the cartridge is used. Therefore, in the illustrated embodiment, toner leakage preventing seals 26 are attached to the widthwise interfaces between the first frame 17 and the second frame 2 to prevent the toner from leaking through the widthwise interfaces.

Incidentally, a conductive wire 27 is provided for detecting a remaining amount of the developer in the developing device. More particularly, by detecting the electrostatic induction between the sleeve 5 and the conductive wire 27, it is possible to detect the remaining amount of the developer.

Figure 8:
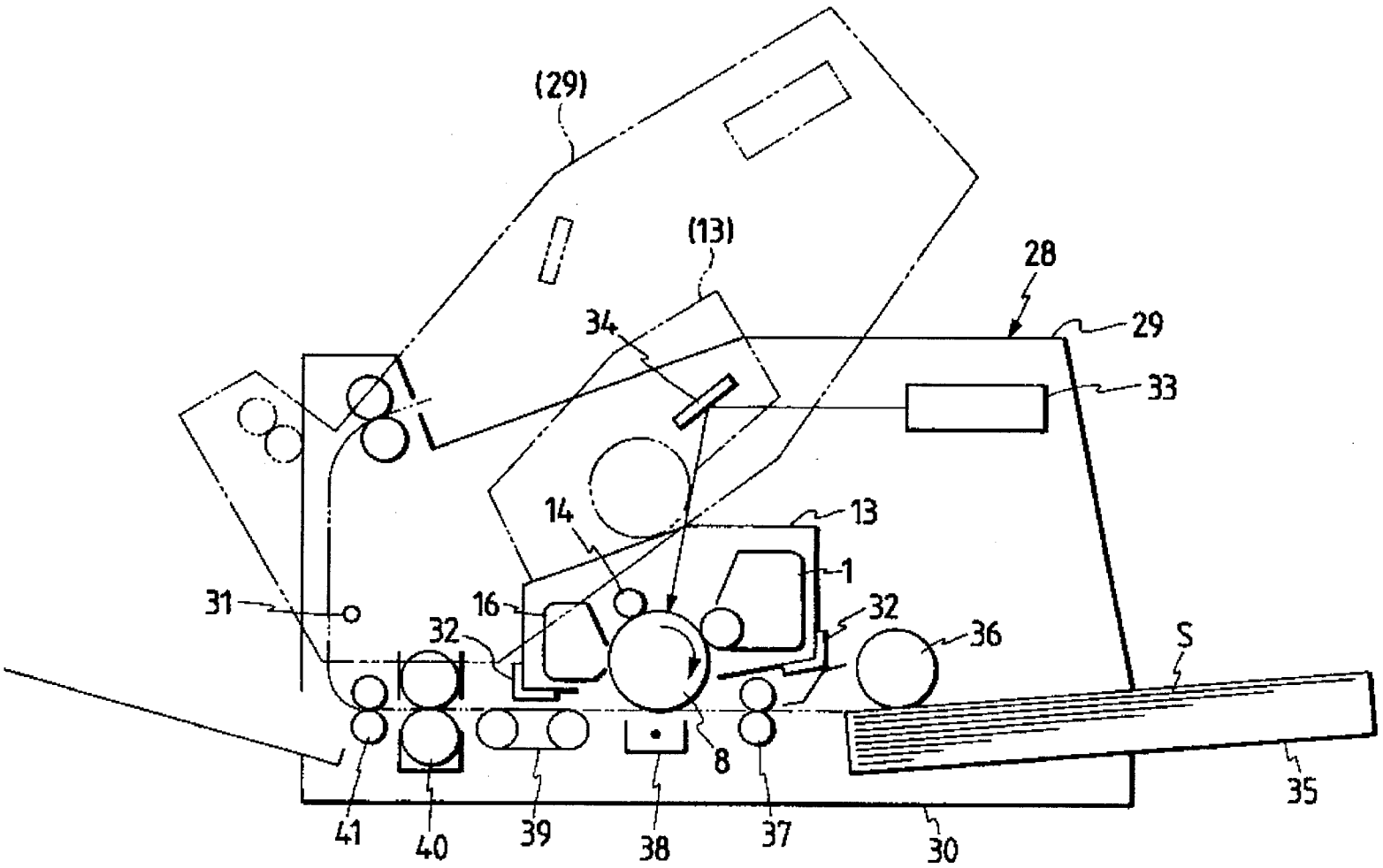
FIG. 8 is an elevational sectional view of a laser beam printer utilizing a process cartridge.

FIG. 8 shows a laser beam printer within which the process cartridge can be removably mounted. The laser beam printer comprises upper and lower cases 29, 30 which can be divided, and the upper case 29 is pivotally mounted on the lower case 30 via pins 31. Incidentally, as shown by the phantom line in FIG. 8, the upper case 29 can be opened for performing the maintenance of the printer (jam treatment, exchange of the process cartridge and the like).

Cartridge supporting members 32 for removably supporting the process cartridge 13 are attached to the upper case 29. Further, a scanner unit 33 is arranged at an upper part of the upper case 29, which laser unit serves to scan a laser beam. In addition, a mirror 34 is disposed near the laser unit 33 to deflect the laser beam so that the laser beam is illuminated onto the surface of the photosensitive drum 8 to form the electrostatic latent image on the drum.

On the other hand, a cassette 35 containing transfer sheets S therein is removably mounted on the lower case 30. Further, a sheet supply roller 36 is rotatably supported above a front end portion of a stack of the transfer sheets S and is rotatingly driven by a drive means (not shown). A pair of regist rollers 37 are disposed at a downstream side (left side in FIG. 8) of the sheet supply roller 36, which regist rollers serve to feed the transfer sheet S toward the downstream side in registration with the photosensitive drum 8. Further, conventional convey device 39, fixing device 40 and discharge rollers 41 are arranged at a downstream side of a transfer device 38 so that after the transferring operation the toner image transferred to the transfer sheet S is fixed and then the transfer sheet is discharged out of the case 29.

When a predetermined signal is emitted, the photosensitive drum 8 is rotated, and the primary charger 14 starts to uniformly charge the surface of the photosensitive drum 8. Then, the scanner unit 33 is driven to illuminate the laser beam onto the photosensitive drum 8 to form the electrostatic latent image on the drum. The electrostatic latent image is sent to the developing sleeve 5 of the developing device 1 as the photosensitive drum 8 is further rotated. In this way, the electrostatic latent image is developed to form the toner image on the photosensitive drum 8. On the other hand, while the toner image is being formed, the sheet supply roller 36 is rotatingly driven to feed the transfer sheet S from the cassette 35. Then, the pair of regist rollers 37 feed the transfer sheet S between the photosensitive drum 8 and the transfer device 38 in registration with the rotation of the photosensitive drum 8. When the transfer sheet S is fed, the transfer device 38 is driven so that the high voltage is applied between the photosensitive drum 8 and the transfer device 38 via the transfer sheet S. In this way, the toner image formed on the photosensitive drum 8 is transferred onto the transfer sheet S. After the transferring of the toner image, the transfer sheet S is sent, by the convey device 39, to the fixing device 40, where the image is fixed to the transfer sheet. Thereafter, the transfer sheet is discharged out of the printer by the discharge rollers 41.

Incidentally, after the transferring operation, the residual toner remaining on the photosensitive drum 8 is removed by the cleaning blade 18 of the cleaning device 16 as the photosensitive drum 8 is rotated, thereby cleaning the surface of the photosensitive drum.

What is claimed is:

1. A developing device, comprising:

a container for containing developer therein;

a developer bearing rotating member disposed at an opening of said container and being adapted to move in a moving direction while bearing a layer of the developer thereon;

an elastic regulating member disposed along a longitudinal direction of said developer bearing rotating member and abutted against said developer bearing rotating member for regulating a thickness of the layer of the developer;

an end portion seal member provided at least at a position in a circumferential direction of said developer bearing rotating member that corresponds to a regulating portion of said elastic regulating member, said end portion seal member being provided outside of said elastic regulating member in the longitudinal direction of said developer bearing rotating member such that a gap exists between said end portion seal member and said elastic regulating member, whereby no pressure is produced between said elastic regulating member and said end portion seal member as a result of the gap; and a flexible sheet member provided downstream in the moving direction from said elastic regulating member at a position corresponding to the gap in the longitudinal direction of said developer bearing rotating member so as to return any developer present in the gap to said container to prevent the developer from leaking from said container.

2. A developing device according to claim 1, wherein said end portion seal member is provided along the circumferential direction of said developer bearing rotating member.

3. A developing device according to claim 2, wherein said flexible sheet member is provided so as to overlap said end portion seal member.

4. A developing device according to claim 3, wherein said end portion seal member is provided at both end portions of said developer bearing member, and said flexible sheet overlaps the both end portions.

5. A developing device according to claim 1, wherein said elastic regulating member comprises a rubber material.

6. A developing device according to claim 1, wherein said developer comprises a one-component magnetic toner.

7. A developing device according to claim 1, wherein said device is provided in a cartridge with an image bearing member.

8. A developing device according to claim 1, wherein said elastic regulating member is blade-like.

* * * * *

UNITED STATES PATENT AND TRADEMARK OFFICE

CERTIFICATE OF CORRECTION

PATENT NO. : 5,585,895

DATED : December 17, 1996

INVENTOR(S) : MASAHIKO YASHIRO, ET AL.

It is certified that error appears in the above-indentified patent and that said Letters Patent is hereby corrected as shown below:

COLUMN 1:

Line 67, "in" should read --to--.

COLUMN 2:

Line 34, "E-E" should read --2-2--; and
Line 36, "F-F" should read --3-3--.

COLUMN 4:

Line 4, "lead" should read --leak--; and
Line 16, "0n" should read --On--.

COLUMN 5:

Line 48, "there" should read --there- --.

COLUMN 6:

Line 46, delete "is" (first occurrence); and
Line 59, "herical" should read --helical--.

UNITED STATES PATENT AND TRADEMARK OFFICE

CERTIFICATE OF CORRECTION

PATENT NO. : 5,585,895 Page 2 of 2

DATED : December 17, 1996

INVENTOR(S) : MASAHIKO YASHIRO, ET AL.

It is certified that error appears in the above-indentified patent and that said Letters Patent is hereby corrected as shown below:

COLUMN 9:

Line 10, "bearing" should read --bearing rotating--.

Signed and Sealed this

Twenty-fourth Day of June, 1997

Bruce Lehman

*Attest:*

BRUCE LEHMAN

*Attesting Officer*

*Commissioner of Patents and Trademarks*